United States Patent [19]

Easterbrook

[11] Patent Number: 4,931,784

[45] Date of Patent: Jun. 5, 1990

[54] COMPUTER GRAPHICS

[75] Inventor: James E. Easterbrook, Sutton, England

[73] Assignee: Rank Cintel Limited, United Kingdom

[21] Appl. No.: 64,198

[22] Filed: Jun. 19, 1987

[30] Foreign Application Priority Data

Jun. 19, 1986 [GB] United Kingdom ..... 8614915

[51] Int. Cl.[5] ..... G09G 1/06

[52] U.S. Cl. ..... 340/728; 340/744; 340/747

[58] Field of Search ..... 340/728, 747, 723, 709, 340/706, 744, 703, 736

[56] References Cited

U.S. PATENT DOCUMENTS

| | | | |
|---|---|---|---|
| 4,626,838 | 12/1986 | Tsujioka et al. | 340/728 |
| 4,633,416 | 12/1986 | Walker | 340/703 |
| 4,646,076 | 2/1987 | Wiedenman | 340/728 |
| 4,796,020 | 1/1989 | Budrikis et al. | 340/728 |

FOREIGN PATENT DOCUMENTS 2076570 12/1981 United Kingdom .

2140257 11/1984 United Kingdom .

OTHER PUBLICATIONS

IBM Tech. Disc. Bul., vol. 21, No. 3, Aug. 1978 "Automatic Filling of Bounded Areas In a Raster Display", A. Appel and C. J. Evangelisti.

Computer Graphics, Hearn et al., pp. 91–92 (Prentice-Hall 1986).

Fundamentals of Interactive Computer Graphics, Foley et al., pp. 436–437 (Addison-Wesley 1982).

Procedural Elements For Computer Graphics, Rogers, pp. 94–97 (McGraw-Hill 1985).

*Primary Examiner*—David K. Moore

*Assistant Examiner*—Richard Hjerpe

*Attorney, Agent, or Firm*—Ostrolenk, Faber, Gerb & Soffen

[57] ABSTRACT

A line segment display is generated as two peripheral sections joined by a middle section. The middle section is generated as a series of bars of pixels, so that no pixel falls in more than one bar, and so that a calculation to determine whether or not a pixel is within or outside the line segment is carried out only once for each pixel.

22 Claims, 6 Drawing Sheets

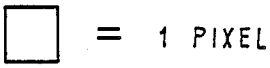
FIG. 1
PRIOR ART
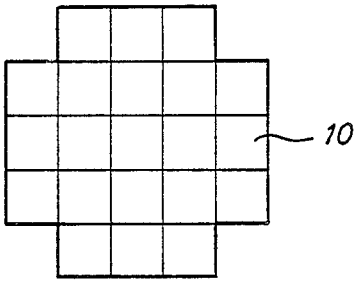

COMPUTER GRAPHICS

FIELD OF THE INVENTION

The present invention relates to computer graphics and, more particularly, to the generation of line segment displays on video screens.

BACKGROUND OF THE INVENTION

Many computer graphics systems allow the operator to draw shapes on a screen by using an electronic pen. The pen is moved across the screen or a special tablet by the operator, as if sketching on paper. The position of the pen is repeatedly sensed by the system, and the displayed image is repeatedly updated to show an image of chosen shape at each sensed position. The shape is a cluster of pixels referred to as a brush shape. Some systems allow a choice of brush shape.

The gap, if any, between the brush shape at a newly sensed position and the previously sensed position is filled with a straight line of brush shapes. Thus, a series of short straight line images, known, as line segments, builds up across the screen. If these line segments are sufficiently short, an apparently smooth curve can be produced. The length of the segments depends on the speed at which the pen is moved, and the rate at which the pen position is sensed.

One known method of drawing a straight line segment can be understood by reference to FIGS. 1 and 2. FIG. 1 shows a typical brush shape 10 which is a cluster of twenty-one pixels. This brush shape will appear as a small round spot on a display when viewed from a normal viewing distance.

FIG. 2 shows a line segment 12 formed by a series of brush shapes like the shape 10. The line segment 12 comprises twenty-two spaced, overlapping shapes 10, centred at respective screen positions 14. It can be clearly seen from FIG. 2 that the brush shapes 10 overlap each other to a considerable extent. For instance, two shaded shapes centred on centres 14*a* and 14*b* have fourteen pixels in common.

The hardware for generating a graphics display like that of FIG. 2 commonly includes a picture store having a storage element corresponding to each pixel. Data entered in these elements sets the state of the corresponding pixel, such as its colour, brightness etc. The display of FIG. 2 would be built up as follows. The screen position of each centre 14 is determined, and that pixel is set by storing appropriate data in the corresponding storage element. The identity of the other pixels necessary to display a brush shape centred on that pixel are then calculated and these pixels are similarly set. Having generated a complete brush shape centred on one position 14, the process is repeated to generate another brush shape, centred on the next position 14, until the whole line of brush shapes has been generated.

There is a problem associated with this technique. The centres 14 must be closely spaced, in order that the shapes 10 blend to form a smooth line segment 12, but this gives rise to a high degree of overlap of the shapes. The generation of each brush shape entails calculation of the position of 21 pixels and addressing 21 storage elements to set those pixels. Thus, 462 (21 x 22) calculating and addressing operations are carried out to display the line segment 12. However, much of this processing is superfluous because of the overlaps. The line segment 12 only consists of 146 distinct pixels.

It is an object of the present invention to make the generation of line segment displays more efficient, by reducing or eliminating duplication of the operations involved in setting pixels.

SUMMARY OF THE INVENTION

One aspect of the invention relates to a method of generating a line segment display on a video screen, wherein:

said line segment is notionally divided during generation into a middle section and two peripheral sections contiguous with said middle section;

said middle section is generated as a series of parallel bars of pixels longitudinally displaced with respect to each other according to the slope of said line segment; and the outlines of said peripheral sections are determined by a brush shape notionally used to draw said line segment.

The use of a middle section consisting of a series of parallel bars of pixels means that each pixel will form part of only one bar, and so will be set only once. The operations necessary to generate the peripheral sections will be of substantially the same complexity as those needed to generate first a single brush shape in the method of FIG. 2. Thus, the method of the invention represents a saving in the amount of calculation needed, and can be expected to yield an increase in the speed of generation.

Preferred features of the invention are defined below in subsidiary claims dependent on claim 1.

Another aspect of the invention relates to apparatus for generating a line segment display on a video screen, comprising; generating means for generating a middle section and two peripheral sections of the line segment, the peripheral section being contiguous with the middle section;

the generating means comprising means operable to display a series of parallel bars of pixels longitudinally displaced with respect to each other according to the slope of the line segment; and means operable to determine the outlines of the peripheral section displayed in dependence on the brush shape notionally used to draw the line segment.

BRIEF DESCRIPTION OF THE DRAWINGS

An example of a method according to the invention and an example of apparatus suitable for implementing the method will now be described in more detail with reference to the accompanying drawings, in which:

FIG. 1 shows schematically an example of a conventional brush shape;

DETAILED DESCRIPTION OF A PREFERRED EMBODIMENT

Figure 3:
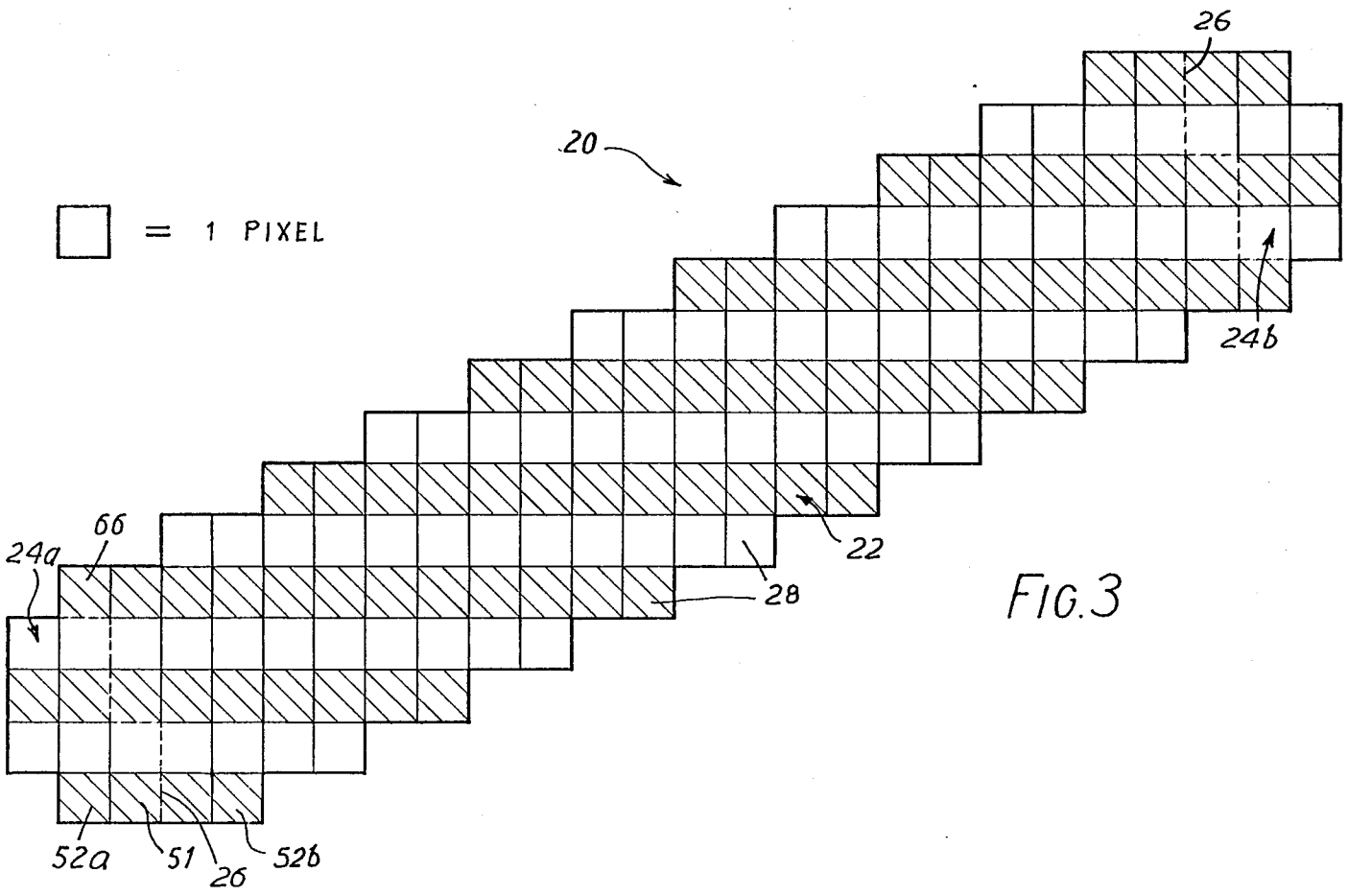
FIG. 3 shows schematically a screen displaying a line segment generated in accordance with the present invention.

FIG. 3 shows a line segment display 20 whose outline is the same as that of the display 12. However, in its generation, the line segment 20 is notionally divided into a middle section 22 and two peripheral sections 24*a*, 24*b*. Broken lines 26 indicate the borders of the sections.

The middle section 22 is generated as a series of parallel bars 28 of pixels, shown alternately shaded and unshaded in FIG. 3. The bars 28 are displaced with respect to each other according to the slope of the line segment 20, so that the middle section appears to the viewer to be a sloped line segment of constant width. The bars lie along scanning lines of the display and so can be generated simply, by hardware to be described.

Figure 2:
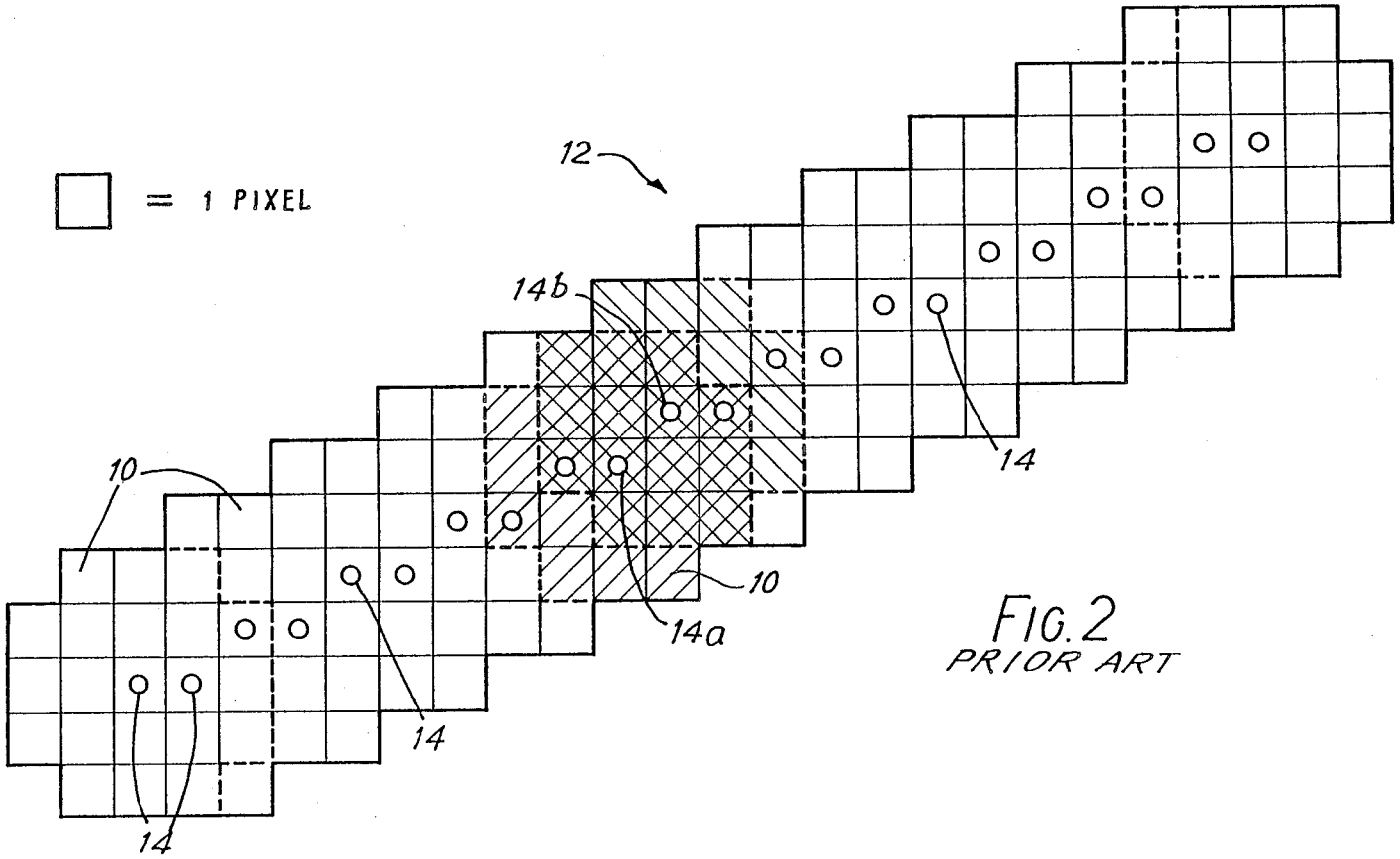
FIG. 2 PRIOR ART
FIG. 2 shows schematically a screen displaying a line generated by a conventional method and apparatus.

The peripheral sections 24*a*, 24*b* are contiguous with the middle section and have outlines determined by the brush shape notionally used to draw the line segment 20. In FIG. 3, the brush shape 10 used in FIG. 2 has notionally been used. Each peripheral section has the approximate outline of a brush shape 10 divided along a line which runs through the centre of the brush shape and is perpendicular to the direction of the line segment. Thus, the middle section is approximately rectangular, having two long sides with the same gradient as the line segment, and two shorter, perpendicular sides abutting the peripheral sections. The peripheral sections are semi-circular, since the brush shape 10 appears circular.

The term "slope" is used here with due regard to the essentially discrete nature of a pixel display. This prevents the term having its normal, precise geometrical meaning. For instance, the outline of the brush shape 10 is always either vertical or horizontal. However, by analogy with the notional circle which the shape 10 represents, the shape can be considered to have a slope which smoothly varies around its outline. Similarly, the staircase-shaped outline 26 of each edge of the middle section is a discrete representation of a straight line which has a well defined slope, and this value of slope can be ascribed to the edges of the middle section. It can also be seen from this analogy that the slope may vary continuously from 0° to 360°. As will be described, the edges of the middle section 22 can be considered tangential at each end to the outlines of the peripheral sections.

Figure 4:
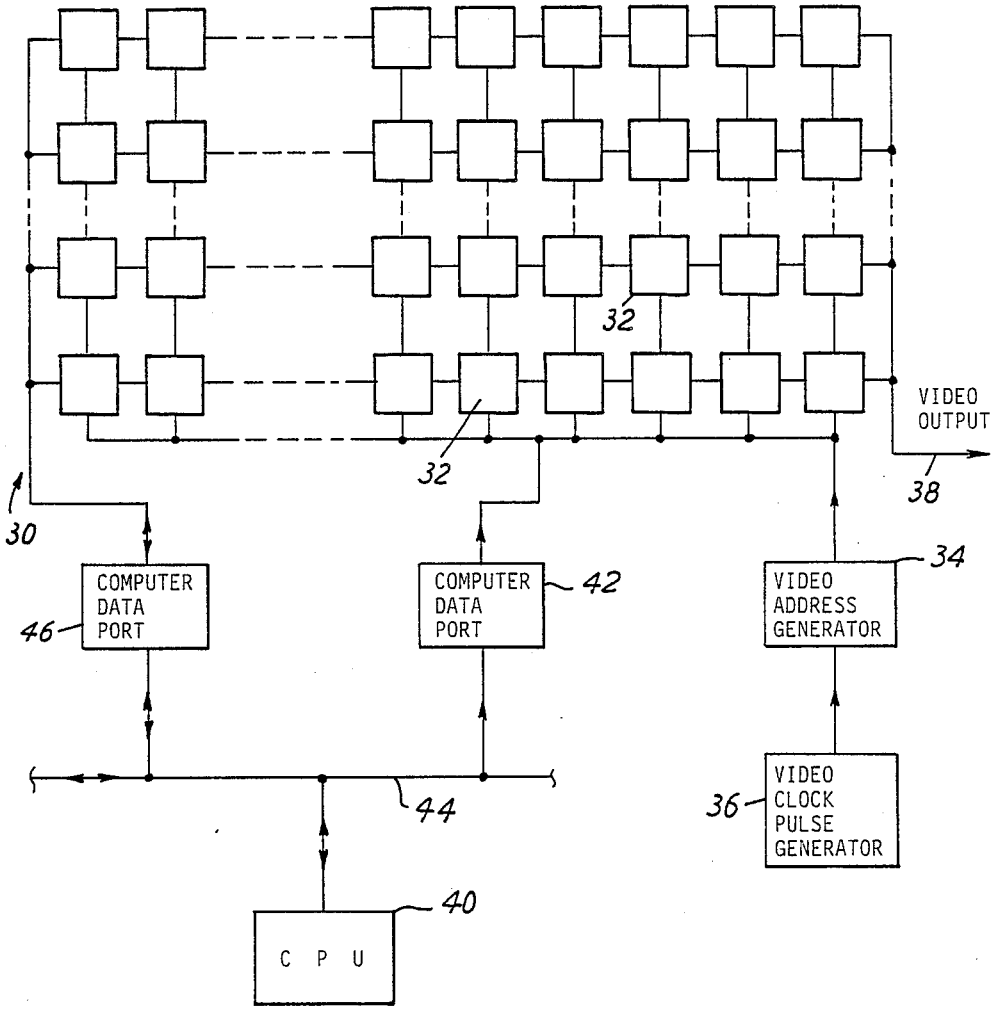
FIG. 4 is a schematic diagram of apparatus for generating a video output for the screen of FIG. 3.

FIG. 4 shows an example of hardware for implementing the method of the invention. This includes a picture store comprising an array 30 of storage elements 32 each representing a respective pixel. The elements 32 can be addressed sequentially by a video address generator 34, under the control of a video clock pulse generator 36, to produce an output 38 which forms the basis of a standard video signal for use by a video display.

The contents of the elements 32, determining the image displayed, are set by a computer 40. This controls a second address generator 42 over a bus 44 to address individual elements 32. Once addressed, data can be written into the element by the computer 40, through a data port 46, also connected to the computer 40 by means of the bus 44.

The operation of the computer 40 in generating the line segment 20 will now be described with reference to FIG. 5.

The process begins at step 50 by initialising the variables "RH side" and "LH side" for the first scanning line to be drawn. These are used to identify the pixels at edges of the line segment 20 in any scanning line. FIG. 5 shows LH side and RH side being set to zero. Naturally other initial values can be chosen, according to the location of the line segment on the screen. In the following discussion, it is assumed that RH side and LH side both initially indicate pixel 51 (FIG. 3).

The slope of the peripheral portion 24*a* at its left hand edge (in the sense discussed above) is compared at step 54 with the slope of the line segment to be displayed. If the slope of the peripheral portion is the greater, LH side is set at step 56 to a value selected according to the brush shape being used, so that the peripheral section will appear to have been drawn with this brush shape. In this case, step 56 would first set LH side to identify pixel 52*a* (FIG. 3).

At step 58, the slope of the right hand edge of the peripheral portion is compared with the slope of the line segment and if less, RH side is set, at step 60, according to the brush shape. In this case, the initial value of RH side represents the right hand edge of the peripheral portion 24*a*. Accordingly, the slope of the peripheral portion is vertical and already exceeds the slope of the line segment. RH side is thus first set according to the line segment slope by step 76, and indicates pixel 52*b*.

The storage elements 32 corresponding to the pixels identified by LH side and RH side, and the pixels between these edges, are addressed at step 62 and loaded with data to set those pixels to display the colour etc. chosen for the line segment display.

If the generation is not then complete, that is, if two peripheral sections and a middle section have not been completed, the process reverts from step 64 to repeat the decision at step 54 in respect of the next higher scanning line.

Step 56 will repeatedly assign values to LH side according to the brush shape, to give the peripheral region 24*a* the outline of the brush shape, until the decision step 54 determines that the slope of the left hand edge of the peripheral portion equals the slope of the line segment being generated. This will occur when LH side identifies pixel 66 in FIG. 3. Steps 68 and 70 then take over to identify the left hand edge of the middle portion in each scanning line. Step 70 assigns a value to LH side which identifies the pixel in the next line above and lying on a line having the slope of the line segment and passing through the pixel currently identified by LH side. LH side continues, line by line, to follow the slope of the line segment until the decision step 68 determines that the left hand edge of the middle section is tangent to a brush shape located at the end of the line segment (and forming the peripheral section 24*b*). This may be done simply by comparing the number of times step 70 has been executed with the vertical distance between the centres of the brush shapes represented by the peripheral sections. Values are subsequently assigned to LH side according to the outline of the brush shape (the peripheral section 24*b*) by step 72, until the peripheral section 24*b* is completed.

Similarly, new values are assigned, line by line, to RH side by step 60 until the decision step 58 determines that the slope of the right hand edge of the peripheral section has risen to equal the slope of the line segment. In the example shown in FIG. 3, this will occur immediately, as explained above. Steps 74,76 take over for subsequent lines to change the value of RH side so that the edge of the line segment has the same slope as the line segment. The steps 74,76 are repeatedly executed until the decision step 74 determines that the right hand edge of the line segment 20 is tangent to the upper peripheral section 24b. The right hand edge of the peripheral section 24b is then formed by step 78 according to the brush shape.

Figure 5:
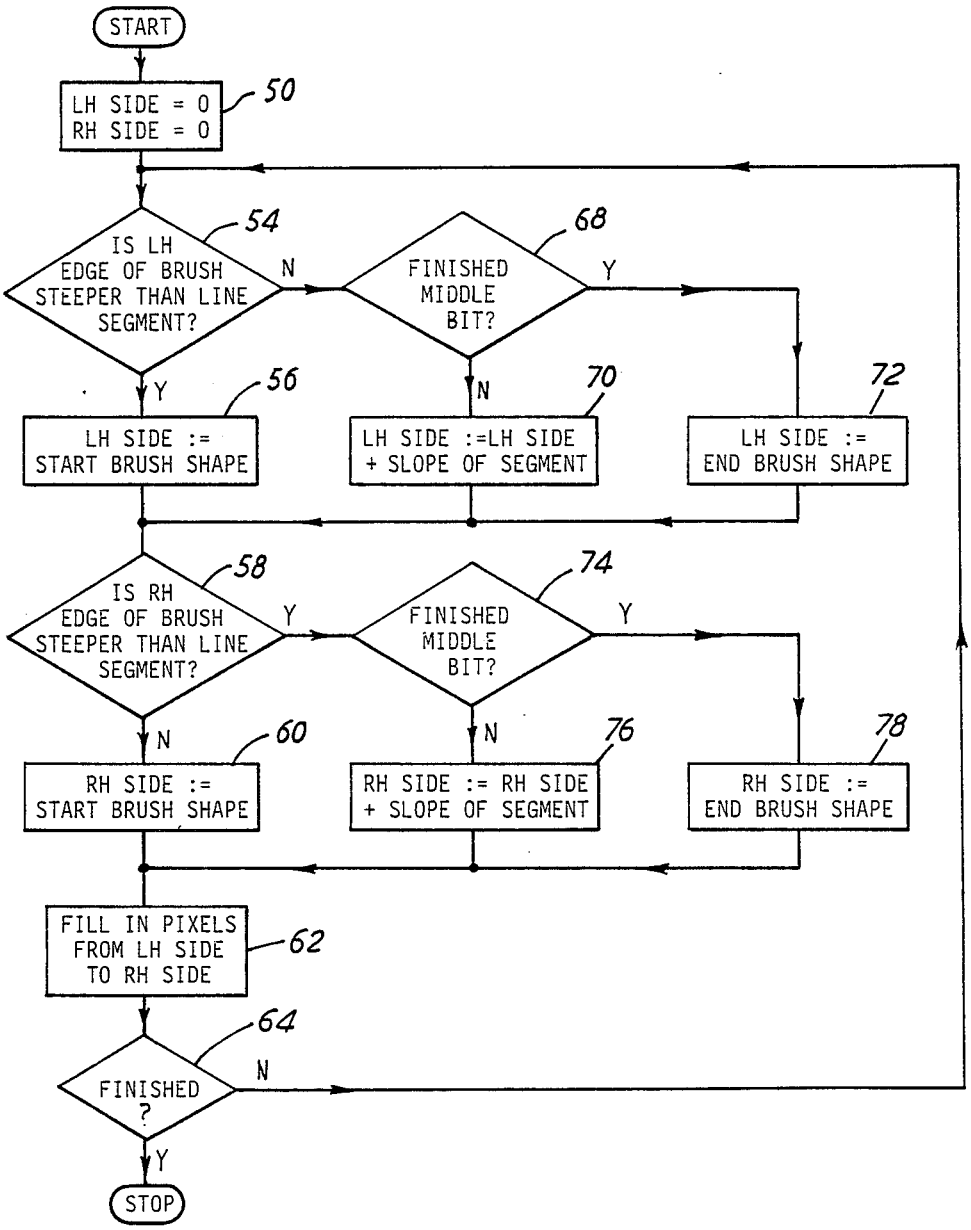
FIG. 5 is a flow diagram showing the processing steps carried out by the computer of FIG. 4.

In summary, the process shown in FIG. 5 determines the position of the edge pixels for each line forming part of the line segment. These pixels can be set by addressing the corresponding storage elements 32. Having determined the edge pixels, the pixels between the edge pixels are set to generate a bar of pixels, by scanning the corresponding line of storage elements 32.

The brush shape notionally used to draw the line segment 20 can be changed by changing the algorithms used to assign values in steps 56,72, 60 and 78.

The method described above is well suited to a line drawing system which uses anti-aliassing. If the brush shape is stored in a high definition form, the ideal position of the edge of the line segment, which may be between real pixels, can be simply calculated and used to select the anti-aliassing filter function used.

Figure 6:
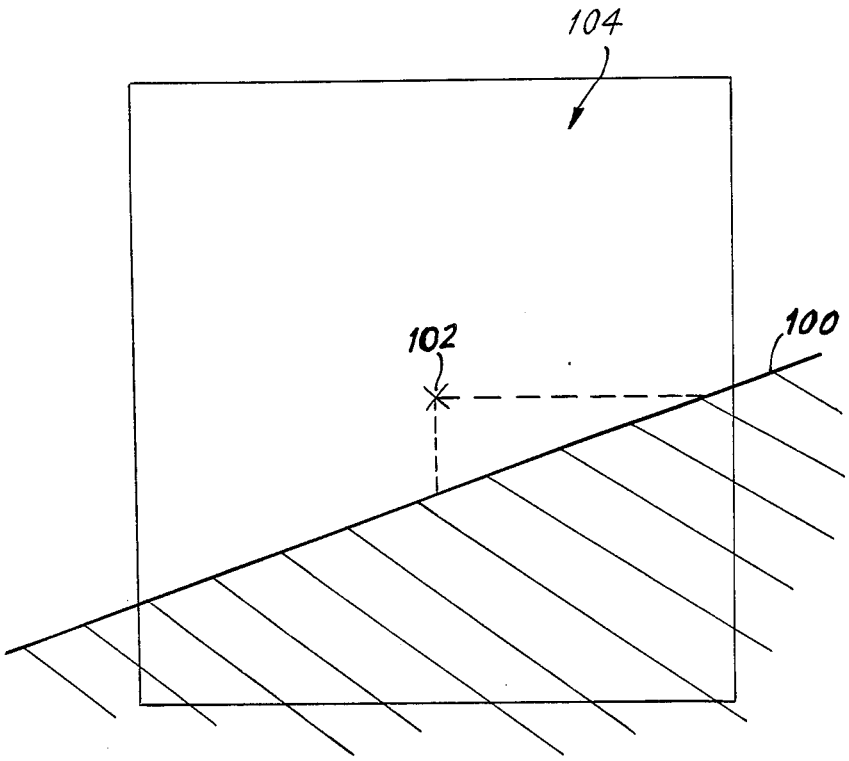
FIG. 6 PRIOR ART
FIG. 6 is a schematic diagram for illustrating a conventional anti-aliassing technique.

Anti-aliassing may be achieved, for example, by the well-known systems discussed in Hearn et al., Computer Graphics, pp 91–92 (Prentice-Hall 1986); Foley et al., Fundamentals of Interactive Computer Graphics, pp 436–437 (Addison-Wesley 1982; and Rogers, Procedural Elements for Computer Graphics, pp. 94–97 (McGraw-Hill 1985 ). See also U.S. Pat. No. 4,796,020 to Bufrikis et al. More specifically, anti-aliassing may be achieved by mixing the color of the brush shape with the original or background color of the pixel in a ratio determined by the proportion of the pixel which would be shaped if the nominal edge of the line actually divided the pixel into two parts. This ratio can be calculated from the slope of the edge and its distance from the center of the pixel. This can, in practice, be rather complicated, so in practice, the ratio is determined by a rather more approximate method. Firstly, the angular range within which the slope lies is determined, that is, 315°–45°, 45°–135°, 135°–225° or 225°–135°. Then the horizontal or vertical distance of the nominal line edge 100 (as shown in FIG. 6) from the center 102 of the pixel 104 is determined. This distance may be negative. The final pixel color is then calculated depending on the angular range and the distance determined. For the example shown:

final color=((0.5+ distance) * initial color)+((0.5−-distance) * brush color).

What we claim is:

1. A method of generating a line segment display comprising multiple-pixel lines and drawn according to a predetermined brush shape on a video screen, comprising the steps of:

defining in said line segment, during generation, a middle section and two peripheral sections contiguous with said middle section;

generating said middle section as a series of parallel bars of pixels which extend in a predetermined direction on said video screen, said parallel bars being staggered in said predetermined direction with respect to each other according to the slope of said line segment; and determining outlines of said peripheral sections according to said predetermined brush shape used to draw said line segment.

2. A method according to claim 1, in which two pixels representing the edges of the line segment are determined line by line for each pixel line of the screen.

3. A method according to claim 2, wherein pixels representing an interior region of the line segment are subsequently determined by reference to said pixels representing edges of said line segment.

4. A method according to claim 2 wherein, for each pixel bar forming part of said middle section, the position along the pixel bar of the edge pixels is determined by reference to the position of the edge pixels of a neighbouring bar and the slope of the line

5. A method according to claim 2, wherein each peripheral section comprises a series of parallel bars of pixels defined according to said brush shape, and for each pixel bar forming part of a peripheral section, the position along the pixel bar of at least one edge pixel is determined by reference to the brush shape and the screen position at which the brush shape is centered at the end of the line segment.

6. A method according to claim 1 wherein the line segment display is generated beginning with a peripheral section.

7. A method according to claim 6, wherein for each edge of the line segment, the position of the edge pixel is determined for successive pixel bars in accordance with the brush shape until the slope of that edge of the line segment equals the slope of the line segment, and wherein, in subsequent pixel bars, that edge of the line segment is considered to be in the middle section.

8. A method according to claim 6 wherein, for each edge of the line segment in the middle section, the position of the edge pixel is so determined that the edges have the same slope as the line segment, and the edge is considered to be in the middle section until the edge is tangent to the brush shape when centred at the end of the line segment, and wherein, in subsequent pixel bars, that edge of the line segment is considered to be in a peripheral section.

9. A method according to claim 1, further comprising a step of selecting the brush shape.

10. A method according to claim 1, wherein the display is generated by addressing a picture store having a plurality of storage elements corresponding to respective pixels.

11. A method according to claim 1, in which the brush shape is stored in a high definition form, an ideal position of the edge of the line segment is calculated for each pixel bar with higher definition than is provided by the pixels, and the ideal positions are used to select an anti-aliassing filter function to be applied to the signal supplied to the video screen.

12. Apparatus for generating a line segment display comprising multiple-pixel lines and drawn according to a predetermined brush shape on a video screen, comprising:

generating means for generating a middle section and two peripheral sections of the line segment, the peripheral sections being contiguous with the middle section;

the generating means comprising means operable to display a series of parallel bars of pixels which extend in a predetermined direction on said video screen, said parallel bars being staqqered in said predetermined direction with respect to each other according to the slope of the line segment; and means operable to determine outlines of the peripheral sections displayed in dependence on the predetermined brush shape used to draw the line segment.

13. Apparatus according to claim 12, further comprising identifying means operable to identify two pixels in each pixel bar of the screen, the identified pixels representing the edges of the line segment.

14. Apparatus according to claim 13, wherein the identifying means subsequently identifies pixels representing the interior region of the line segment by reference to the identified edge pixels.

15. Apparatus according to claim 13, wherein the identifying means identifies the edge pixels for each pixel bar forming part of the middle section by reference to the positions of the edge pixels of a neighbouring bar and the slope of the line segment.

16. Apparatus according to claim 13, wherein each peripheral section comprises a series of parallel bars of pixels defined according to said brush shape, and for each pixel bar forming part of a peripheral section, the identifying means is operable to determine the position along the pixel bar of at least one edge pixel by reference to the brush shape and the screen position at which the brush shape is centered at the end of the line segment.

17. Apparatus according to claim 13, wherein the generating means is operable to generate a peripheral section before generating the middle section.

18. Apparatus according to claim 17, wherein the identifying means comprises slope means for calculating the slope of the edges of the line segment, and the identifying means is operable, for each edge of the line segment, to identify an edge pixel for each pixel bar in accordance with the brush shape until the slope of that edge of the shape equals the slope of the line segment, and is operable in subsequent bars to identify pixels by considering that edge to be in the middle section.

19. Apparatus according to claim 17, wherein for each edge of the line segment, in the middle section, the identifying means so identifies edge pixels that the edges have the same slope as the line segment, and the identifying means identifies edge pixels as being in the middle section until the slope means determines that the corresponding edge is tangent to the brush shape when centred at the end of the line segment, and wherein, in subsequent bars, the identifying means identifies edge pixels as being in a peripheral section.

20. Apparatus according to claim 12, further comprising means storing data representing a set of brush shapes and being responsive to an operator to change the brush shape used to draw the line segment.

21. Apparatus according to claim 12, further comprising a picture store having a plurality of storage elements corresponding to respective pixels, and means operable in response to the generating means to store data in the storage elements to cause the line segment to be displayed.

22. Apparatus according to claim 12, further comprising means for storing data representing the brush shape in high definition form, means operable to determine an ideal position of the edge of the line segment in each pixel bar with higher definition than is provided by the pixels, and anti-aliassing means operable in response to the calculated ideal positions to select an anti-aliassing function to be applied to signals supplied to the video screen.

* * * * *